US009355799B2

(12) United States Patent
Jiang et al.

(10) Patent No.: US 9,355,799 B2
(45) Date of Patent: May 31, 2016

(54) FAST CLOSING MECHANISM

(71) Applicants: SEARI ELECTRIC TECHNOLOGY CO., LTD., Shanghai (CN); ZHEJIANG CHINT ELECTRICS CO., LTD., Zhejiang Province (CN)

(72) Inventors: Guping Jiang, Shanghai (CN); Xiang Gu, Shanghai (CN); Huimin Gu, Shanghai (CN); Wenliang Xu, Shanghai (CN); Jichao Bai, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 116 days.

(21) Appl. No.: 14/351,383

(22) PCT Filed: Oct. 9, 2012

(86) PCT No.: PCT/CN2012/082616

§ 371 (c)(1),
(2) Date: Apr. 11, 2014

(87) PCT Pub. No.: WO2013/053308

PCT Pub. Date: Apr. 18, 2013

(65) Prior Publication Data

US 2014/0246404 A1 Sep. 4, 2014

(30) Foreign Application Priority Data

Oct. 14, 2011 (CN) ..... 2011 1 0312440

(51) Int. Cl.
*H01H 71/50* (2006.01)
*H01H 33/40* (2006.01)
*H01H 71/52* (2006.01)

(52) U.S. Cl.
CPC ..... *H01H 33/40* (2013.01); *H01H 71/503* (2013.01); *H01H 71/52* (2013.01); *H01H 2300/046* (2013.01)

(58) Field of Classification Search
CPC ..... H01H 2300/046; H01H 2300/048; H01H 71/05; H01H 71/052
USPC ..... 200/401, 400, 244, 318; 335/191, 167
See application file for complete search history.

(56) References Cited

U.S. PATENT DOCUMENTS

| | | | |
|---|---|---|---|
| 4,687,891 | A | 8/1987 | Bartolo et al. |
| 5,280,258 | A | 1/1994 | Opperthauser |

FOREIGN PATENT DOCUMENTS

| | | | |
|---|---|---|---|
| CN | 2033542 | U | 3/1989 |
| CN | 1239584 | A | 12/1999 |
| CN | 2609164 | Y | 3/2004 |
| CN | 101335162 | A | 12/2008 |

(Continued)

OTHER PUBLICATIONS

EPO Communication pursuant to Rule 114(2) EPC—3rd party observations (Office Action) dated Sep. 26, 2014, issued by the European Patent Office in corresponding European Patent Application No. 12840289.8 (3 pages).

(Continued)

*Primary Examiner* — Renee Luebke
*Assistant Examiner* — Ahmed Saeed
(74) *Attorney, Agent, or Firm* — Osha • Liang LLP

(57) ABSTRACT

A fast closing mechanism includes a rotation shaft and an ejector pin. The ejector pin is rotatably assembled to the side plate by the rotation shaft. The ejector pin strides over the side plate. The ejector pin includes a first portion and a second portion. The first portion is connected to a handle via a rod, and the second portion is located above a press plate. The fast closing mechanism may have an additional ejector pin based on current structures, the press plate may press against a moving contact at an initial stage of a closing process, so that the moving contact will not move during the initial stage of the closing process. The mechanical energy generated during the closing process is stored in an energy storage spring. At a later stage of the closing process, the ejector pin releases the press plate to accomplish closing quickly.

6 Claims, 5 Drawing Sheets

(56) References Cited

FOREIGN PATENT DOCUMENTS

| | | | |
|---|---|---|---|
| DE | 19529869 | A1 | 2/1997 |
| DE | 19703977 | C1 | 5/1998 |
| EP | 0956578 | B1 | 7/2001 |
| EP | 1387377 | A2 | 2/2004 |

OTHER PUBLICATIONS

2nd Official Action dated Feb. 6, 2015, issued by the State Intellectual Property Office of the People's Republic of China in corresponding Chinese Patent Application No. CN 201110312440.7, with an English translation of the Search Report (only). (7 pages).

International Search Report for corresponding International Application No. PCT/CN2012/082616, mailed Jan. 17, 2013 (4 pages).

EPO Communication dated Mar. 9, 2015, with Extended European Search Report dated Feb. 27, 2015, issued by the European Patent Office, Munich, Germany, in corresponding European Patent Application No. EP-12840289.8 (8 pages).

Official Action dated Jun. 26, 2014, issued by the China Patent Office in corresponding Chinese Patent Application No. CN 201110312440.7, with an English translation of the Search Report contained in the Official Action (7 pages).

FAST CLOSING MECHANISM

CROSS REFERENCE TO RELATED APPLICATIONS

This is a national stage application based on PCT/CN2012/082616, filed on Oct. 9, 2012, which claims priority to Chinese Patent Application No. 201110312440.7, filed on Oct. 14, 2011. This application claims the priority of these prior applications and incorporates their disclosures by reference in their entireties.

BACKGROUND OF THE INVENTION

1. Field of the Invention

The present invention relates to low voltage electrical apparatus, more particularly, relates to fast closing mechanism for circuit breaker.

2. The Related Art

Regular motor protection circuit breakers or motor starters with a current level above 25 A are all operated by handles. When operated, the handle rotates in a forward direction means closing (switch on), and the handle rotates in a reverse direction means opening (switch off). Generally, such mechanisms have a fast opening structure because large break arc will be generated during an opening operation. However, many of the mechanisms do not have a fast closing structure, then large arc generated during a closing process may burn and damage the contacts, which may influence the life expectancy of the products.

Most of the mechanisms that are used today have a "slow closing and fast opening" structure, that is, the closing speed is very slow during a closing process. A slow closing process will result in a very large closing arc. According to a high-speed photography based calculation, the "slow closing and fast opening" structure needs a period from several hundreds milliseconds to one second to accomplish the closing process, such a long period may result in closing arc that would be large enough to damage the mechanism.

SUMMARY

The present invention discloses a fast closing mechanism that may shorten the closing process to several milliseconds.

According to an embodiment of the present invention, a fast closing mechanism is disclosed. The fast closing mechanism is mounted on a side plate of a circuit breaker, the fast closing mechanism comprises a rotation shaft and an ejector pin, the ejector pin is rotatably assembled to the side plate by the rotation shaft, the ejector pin strides over the side plate, the ejector pin comprises a first portion and a second portion, the first portion is connected to a handle via a rod, and the second portion is located above a press plate.

According to an embodiment, the first portion of the ejector pin comprises a longitudinally extended rod part and a laterally extended top part, the rotation shaft is mounted on the rod part, the rod part strides over the side plate and connects to the second portion of the ejector pin, the top part has a sliding groove and the rod has a projection, the projection slides within the sliding groove, the ejector pin rotates when the projection touches an end of the sliding groove.

According to an embodiment, the second portion of the ejector pin has a long finger, the long finger presses against the press plate to prevent an upward movement of the press plate; the rod rotates and drives the ejector pin to rotate in a direction reverse to the rotation of the rod so that the press plate separates with the long finger and moves upwards.

According to an embodiment, the second portion of the ejector pin forms a shape of "η".

According to an embodiment, the second part of the ejector pin further comprises a horizontal part and a short finger, the long finger and the short finger connect to each other through the horizontal part, the short finger connects to the rod part in the first portion of the ejector pin.

According to an embodiment, the first portion of the ejector pin is located at an inner side of the side plate and the second portion of the ejector pin is located at an outer side of the side plate.

The fast closing mechanism according to the present invention has an additional ejector pin based on conventional structures. The press plate may press against a moving contact at an initial stage of a closing process, so that the moving contact will not move during the initial stage of the closing process. The mechanical energy generated during the closing process is stored in an energy storage spring. At a later stage of the closing process, the ejector pin releases the press plate, the press plate and the moving contact obtain a large initial speed by the spring force of the energy storage spring and accomplish closing quickly. The period for accomplishing the action of closing is reduced to 2-3 ms.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1A:
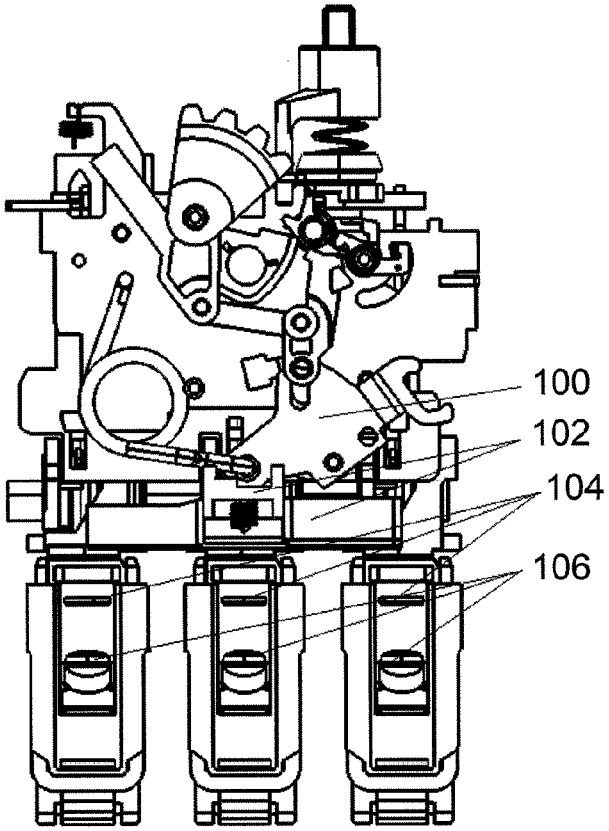
FIG. 1a (Prior Art)
FIGS. 1*a* and 1*b* illustrate a prior art structure of a circuit breaker without a fast closing mechanism.
Figure 1B:
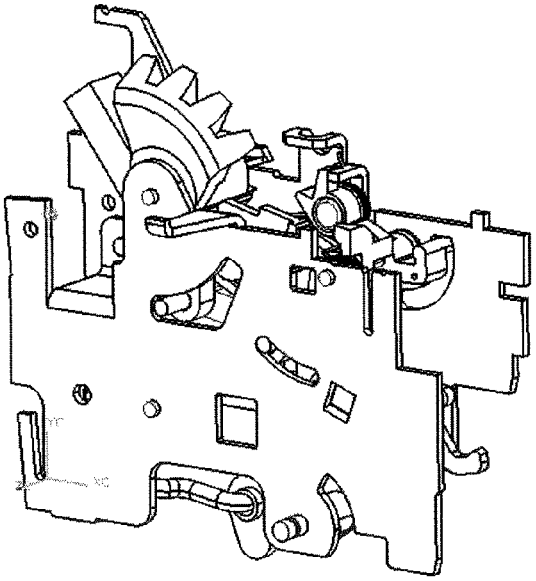
FIG. 1b (Prior Art)

FIGS. 1*a* and 1*b* illustrate a prior art structure of a circuit breaker without a fast closing mechanism. The circuit breaker comprises a push rod 100, a press plate 102, a static contact 104 and a moving contact 106. FIG. 1*a* illustrates the front view of the structure of the circuit breaker. FIG. 1*b* illustrates the solid view of the structure of the circuit breaker. For the circuit breaker according to prior art, during a closing process, the push rod 100 is pulled and drive the press plate to raise, the moving contact 106 raises with the press plate 102 to accomplish closing. Pulling the push rod 100 is realized by manual operation and generally takes 0.5-1 second, or even longer. According to a high-speed photography based calculation, the prior art circuit breaker takes at least 300 ms to accomplish the closing process, and an average value is about 1 second. That means, during the closing process, closing arc with a duration of 1 second will be generated between the static contact and the moving contact, which is very disadvantageous to the contact system.

A basic concept of the fast closing mechanism according to the present invention is as follows: the moving contact does not move during an initial stage of the closing process so that closing arc may be avoided, and an energy storage mechanism stores energy at the same time. During a later stage of the closing process, energy storage is accomplished and the moving contact is released and accelerated by the stored energy, the moving contact obtains a large initial speed and may accomplish the action of closing quickly.

Figure 2A:
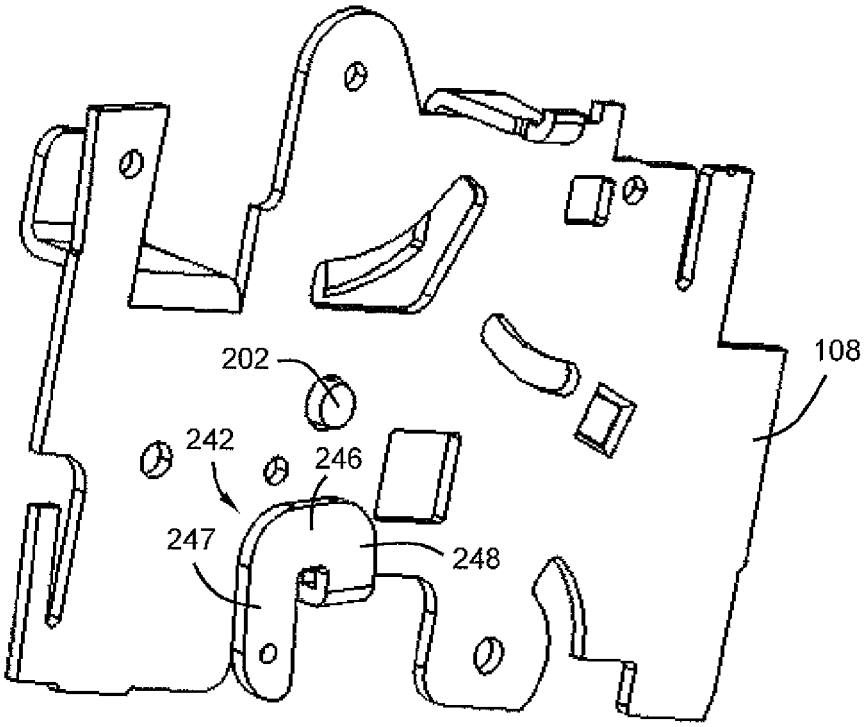
FIGS. 2*a* and 2*b* illustrate the structure of a fast closing mechanism according to an embodiment of the present invention.
Figure 2B:
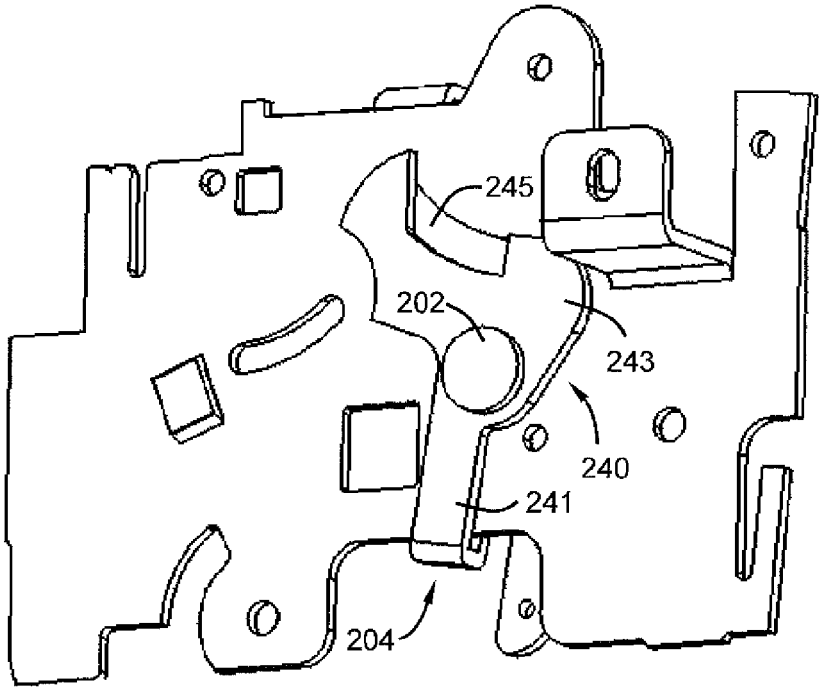

FIGS. 2*a* and 2*b* illustrate the structure of a fast closing mechanism according to an embodiment of the present invention. According to FIGS. 2*a* and 2*b*, the fast closing mechanism 200 is mounted on a side plate 108 of a circuit breaker. The fast closing mechanism 200 comprises a rotation shaft 202 and an ejector pin 204. The ejector pin 204 is rotatably assembled to the side plate 108 by the rotation shaft 202. The ejector pin 204 strides over the side plate 108, the ejector pin 204 comprises a first portion 240 and a second portion 242, the first portion 240 is located at an inner side of the side plate 108 and the second portion 242 is located at an outer side of the side plate 108. The first portion 240 is connected to a handle 304 via a rod 300 (see FIGS. 5*a* and 5*b*), and the second portion 242 is located above a press plate 102 (see FIGS. 3, 4*a* and 4*b*).

Figure 3:
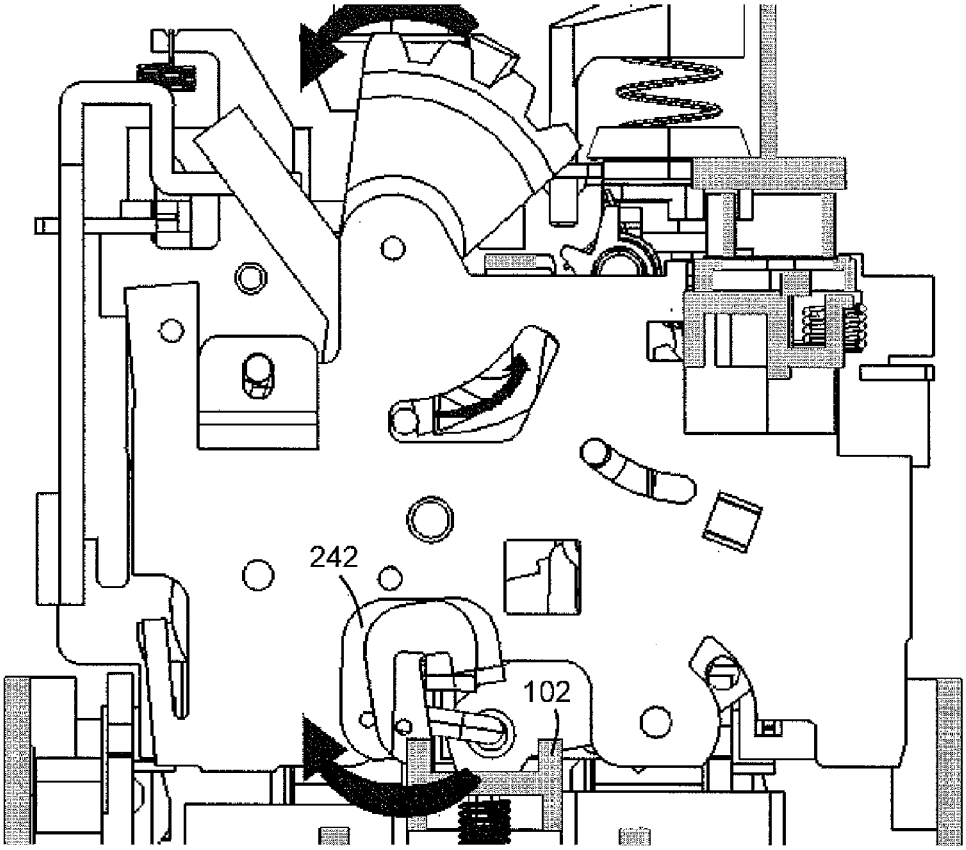
FIG. 3 illustrates the motion mode of the fast closing mechanism according to an embodiment of the present invention.
Figure 4A:
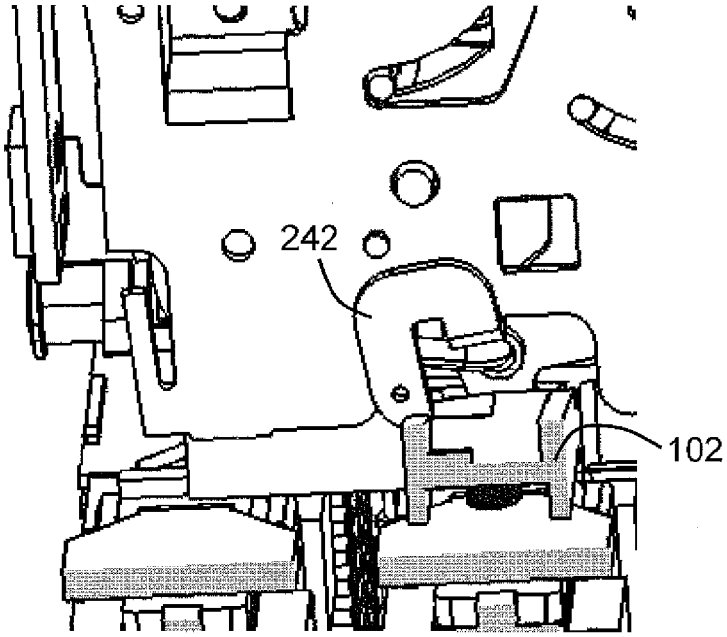
FIGS. 4*a* and 4*b* illustrate the positions of the ejector pin at a closing state and an opening state according to an embodiment of the present invention.
Figure 5A:
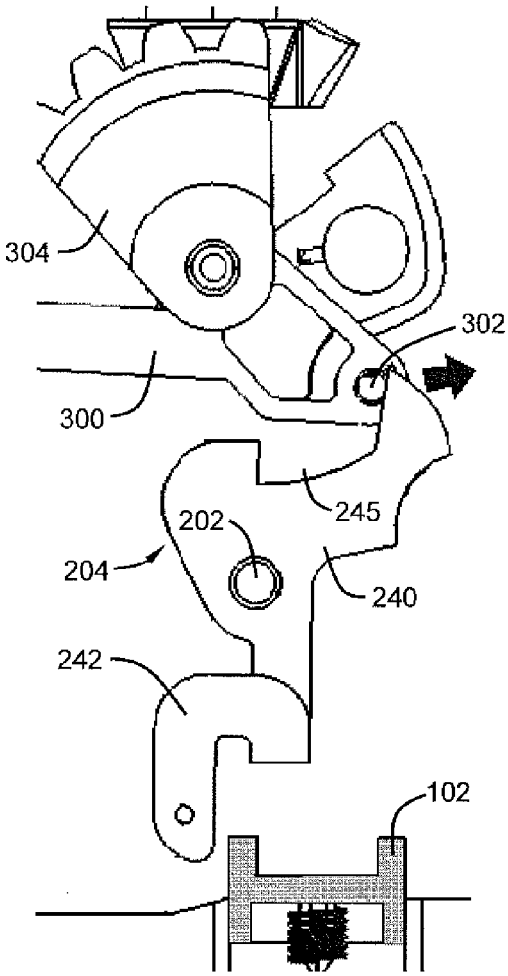
FIGS. 5*a* and 5*b* illustrate a closing state and a reset state of the fast closing mechanism according to an embodiment of the present invention.
Figure 5B:
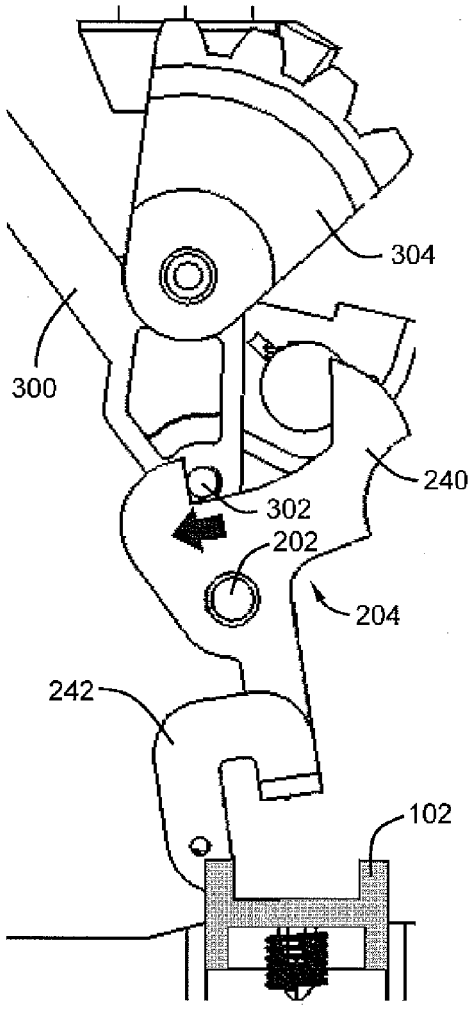

FIG. 2*a* illustrates the outer side of the side plate 108 and the second portion 242 of the ejector pin 204. FIG. 2*b* illustrates the inner side of the side plate 108 and the first portion 240 of the ejector pin 204. As shown in FIGS. 2*a* and 2*b*, the first portion 240 of the ejector pin comprises a longitudinally extended rod part 241 and a laterally extended top part 243. The rotation shaft 202 is mounted at the junction of the rod part 241 and the top part 243. The rod part 241 strides over the side plate 108 and connects to the second portion 242 of the ejector pin. The top part 243 has a sliding groove 245. As shown in FIGS. 5*a* and 5*b*, the rod 300 connects to the handle 304. The rod 300 has a projection 302. The projection 302 slides within the sliding groove 245. The sliding groove 245 has two end faces on both ends to prevent the projection 302 from slip out of the sliding groove 245. When the projection 302 touches the ends (end faces) of the sliding groove 245, the ejector pin 204 is driven to rotate. As shown in FIGS. 5*a* and 5*b*, when performing the action of closing, the projection 302 touches the right end face of the sliding groove 245 and the ejector pin 204 is driven to rotate clockwise (as shown in FIG. 5*a*). When performing the action of opening, the projection 302 touches the left end face of the sliding groove 245 and the ejector pin 204 is driven to rotate counterclockwise (as shown in FIG. 5*b*). The second portion 242 of the ejector pin forms a shape of "η", comprising a horizontal part 246, a long finger 247 and a short finger 248. The long finger 247 connects with the short finger 248 through the horizontal part 246. The long finger 247 presses against the press plate 102 (as shown in FIGS. 3, 4*a* and 4*h*) to prevent an upward movement of the press plate 102. The rod 300 rotates and drives the ejector pin 204 to rotate in a direction reverse to the rotation of the rod 300 (for example, the rod 300 rotates clockwise and the ejector pin 204 rotates counterclockwise) such that the press plate 102 separates from the long finger 247 and moves upwards. The short finger 248 connects with the rod part 241 in the first portion 240 of the ejector pin.

Figure 4B:
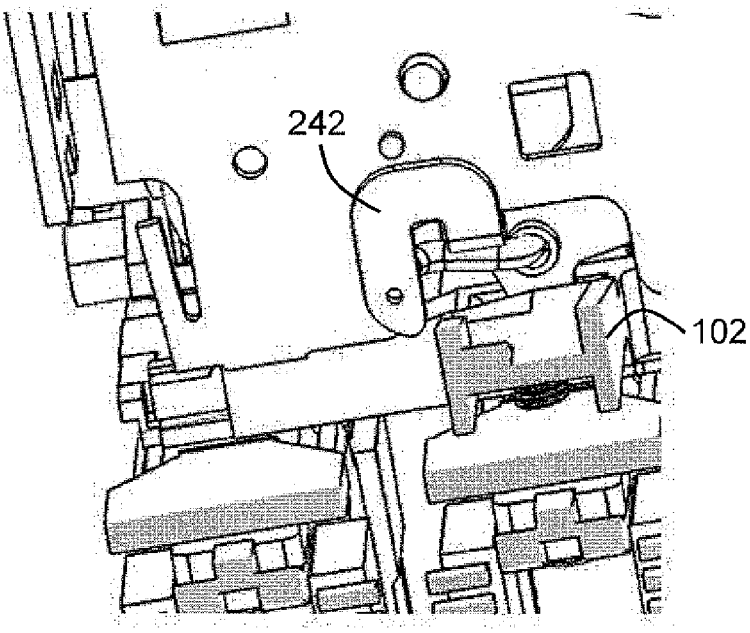

Referring to FIGS. 3, 4*a*, 4*b*, 5*a* and 5*b*, the operation principle of the fast closing mechanism is as follows:

During a closing process, referring to FIG. 5*a* first, the handle 304 rotates and drives the rod 300 to move. The projection 302 slides within the sliding groove 245 from left to right (according to the direction shown in FIG. 5*a*). An initial stage of the closing process is defined as a time period before the projection 302 touches the right end face of the sliding groove 245. During the initial stage, the ejector 204 keeps unmoved as the rod 300 does not apply any force on the ejector 204. The long finger 247 on the second portion 242 of the ejector pin 204 presses against the press plate 102. The press plate 102 and the moving contact both keep unmoved, and an energy storage spring stores energy. A later stage of the closing process is defined as a time period after the projection 302 touches the right end face of the sliding groove 245. The rod 300 pushes the ejector pin 204 to rotate clockwise via the projection 302. The long finger 247 on the second portion 242 of the ejector pin 204 removes from the press plate 102 and the press plate 102 is released. With the energy stored by the energy storage spring, the press plate and the moving contact obtain a large initial speed and may accomplish closing quickly. FIG. 3 illustrates the closing process from an outer view. FIG. 4*b* illustrates the status of the long finger 247 on the second portion 242 of the ejector pin 204 and the press plate 102 during the closing process.

During an opening process, the handle 304 rotates and drives the rod 300 to move. The projection 302 slides within the sliding groove 245 from right to left (according to the direction shown in FIG. 5*b*). After the projection 302 touches the left end face of the sliding groove 245, the rod 300 pushes the ejector 204 to rotate counterclockwise via the projection 302, the long finger 247 on the second portion 242 of the ejector pin 204 moves to a position above the press plate 102 and press against the press plate 102. The press plate 102 further presses against the moving contact to accomplish opening. FIG. 4*a* illustrates the status of the long finger 247 on the second portion 242 of the ejector pin 204 and the press plate 102 during the opening process.

The fast closing mechanism according to the present invention has an additional ejector pin based on current structures, the press plate may press against a moving contact at an initial stage of a closing process, so that the moving contact will not move during the initial stage of the closing process. The mechanical energy generated during the closing process is stored in an energy storage spring. At a later stage of the closing process, the ejector pin releases the press plate, and the press plate and the moving contact obtain a large initial speed by the spring force of the energy storage spring and accomplish closing quickly. The period for accomplishing the action of closing is reduced to 2-3 ms.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A fast closing mechanism, characterized in that the fast closing mechanism is mounted on a side plate of a circuit breaker, the fast closing mechanism comprises a rotation shaft and an ejector pin, the ejector pin is rotatably assembled to the side plate by the rotation shaft, the ejector pin strides over the side plate, the ejector pin comprises a first portion and a second portion, the first portion is connected to a handle via a rod, and the second portion is located above a press plate, wherein the first portion of the ejector pin has a sliding groove, the rod has a projection, the projection is configured to slide within a sliding groove, and the ejector pin is configured to rotate when the projection touches an end of the sliding groove.

2. The fast closing mechanism according to claim 1, characterized in that the first portion of the ejector pin comprises a longitudinally extended rod part and a laterally extended top part, the rotation shaft is mounted on the rod part, the rod part strides over the side plate and connects to the second portion of the ejector pin, the top part has the sliding groove.

3. The fast closing mechanism according to claim 2, characterized in that the second portion of the ejector pin has a long finger, the long finger presses against the press plate to prevent an upward movement of the press plate; the rod rotates and drives the ejector pin to rotate in a direction reverse to the rotation of the rod so that the press plate separates with the long finger and moves upwards.

4. The fast closing mechanism according to claim 3, characterized in that the second portion of the ejector pin forms a shape of "η".

5. The fast closing mechanism according to claim 4, characterized in that the second part of the ejector pin further comprises a horizontal part and a short finger, the long finger and the short finger connect to each other through the horizontal part, the short finger connects to the rod part in the first portion of the ejector pin.

6. The fast closing mechanism according to claim 1, characterized in that the first portion of the ejector pin is located at an inner side of the side plate and the second portion of the ejector pin is located at an outer side of the side plate.

* * * * *